US006457752B1

(12) United States Patent
Miller et al.

(10) Patent No.: US 6,457,752 B1
(45) Date of Patent: Oct. 1, 2002

(54) LOCKING WINDOW

(75) Inventors: D. Keith Miller, Trinity, NC (US); Christopher R. Rogers, Winston-Salem, NC (US); Farrell Smith, Sophia, NC (US)

(73) Assignee: Hughes Supply Company of Thomasville, Inc., Thomasville, NC (US)

( * ) Notice: Subject to any disclaimer, the term of this patent is extended or adjusted under 35 U.S.C. 154(b) by 0 days.

(21) Appl. No.: 09/489,489

(22) Filed: Jan. 21, 2000

(51) Int. Cl.[7] ..... E05C 3/04
(52) U.S. Cl. ..... 292/202; 292/101; 292/241
(58) Field of Search ..... 292/202, 240, 292/241

(56) References Cited

U.S. PATENT DOCUMENTS

| | | | | | |
|---|---|---|---|---|---|
| 3,645,573 | A | * | 2/1972 | Strang | 292/241 |
| 4,093,285 | A | * | 6/1978 | Fayle | 292/251 |
| 4,135,773 | A | * | 1/1979 | Van Remoortel | 308/238 |
| D268,643 | S | | 4/1983 | Anderson | |
| D302,651 | S | | 8/1989 | Mosch | |
| 5,103,533 | A | * | 4/1992 | Pettit et al. | 16/342 |
| 5,219,195 | A | | 6/1993 | Lawrence | |
| 5,248,174 | A | | 9/1993 | Matz et al. | |
| 5,301,989 | A | | 4/1994 | Dallmann et al. | |
| 5,414,899 | A | | 5/1995 | Raetz | |
| 5,489,131 | A | * | 2/1996 | Blom | 292/101 |
| D369,741 | S | | 5/1996 | Harrison et al. | |
| D380,957 | S | | 7/1997 | Evans et al. | |
| D382,191 | S | | 8/1997 | Plummer | |
| D386,384 | S | | 11/1997 | Rausch et al. | |
| 5,741,032 | A | * | 4/1998 | Chaput | 292/202 |
| D418,737 | S | | 1/2000 | Libby et al. | |
| D432,292 | S | * | 10/2000 | Miller | D8/330 |
| D432,392 | S | | 10/2000 | Miller et al. | |
| D442,058 | S | | 5/2001 | Miller et al. | |

* cited by examiner

*Primary Examiner*—Anthony Knight
*Assistant Examiner*—Mark Williams
(74) *Attorney, Agent, or Firm*—MacCord Mason PLLC

(57) ABSTRACT

A locking window. The window includes a window frame including a window sash which is selectively movable between a first closed position and a second open position. A window latch is adapted to be attached to the window and is selectively movable between a first open position and a second locked position to secure the window sash in the closed position. The window latch includes a sweep latch, which is preferably offset, and a non-compressible pivot fastener for attaching the window latch to the window. The offset arrangement provides sufficient space for substantially unequal length actuator and locking arms to provide a mechanical advantage when the window latch is operated. The pivot fastener includes a support bushing and a fastener extending through the support bushing for attaching the offset sweep latch to the window. In the preferred embodiment, the base of the support bushing extends outward to form a load distributing surface and the distal end of the support bushing extends above the surface of the offset sweep latch to allow the offset sweep to move freely about the pivot fastener. A housing extends beyond the pivot fastener parallel to the window frame and includes an aperture for receiving a fastener for attaching the housing to the window. A portion of the housing extending beyond the pivot fastener parallel to the window frame may include a finger well for providing access to the offset sweep latch. In the preferred embodiment, a detent retains the offset sweep latch in its open and locked positions and also provides an audible indication of the position of the offset sweep latch.

34 Claims, 4 Drawing Sheets

FIG. 1

LOCKING WINDOW

BACKGROUND OF THE INVENTION (1) Field of the Invention

The present invention relates generally to a locking window and, more particularly, to a window latch for such a window.

(2) Description of the Prior Art

Up to the end of World War II, most windows were constructed of wood. However, following the War, aluminum windows were initially constructed for low-end housing. Over time, the clear superiority of metal windows led to their use in many different types of housing. Similarly, vinyl windows were introduced in low-end housing in the beginning of the last decade. The use of vinyl windows has grown much more quickly than metal windows. In fact, the majority of windows are now constructed of vinyl.

During this time, locking windows have generally used metal latches similar to those that were initially used on wooden windows. Now, although vinyl windows are the predominant construction, there has still been a hesitancy to use plastic hardware. However, metal or where is much heavier than its corresponding plastic counterpart. Also, plastic retains its appearance when mishandled or otherwise mis-used which would causes unacceptable chips to form on painted metal hardware. Also, in today's modern economy, window hardware may be made in another country. Accordingly, advantages of substantially weight savings in lower shipping costs has become even more important.

However, making a locking window having a plastic latch is more than a mere substitution of materials. Because plastic is generally more flexible than metal, attempts at constructing a window latch having a center mounted sweep latch have failed since there's not a sufficient amount of support across the center of the sweep to prevent bowing. The importance of bowing is primarily due to the requirement by most manufacturers that the sweep latch be able to maintain a static load of about 160 pounds. When a conventional center mounted sweep latch is formed from plastic materials, the bowing of the sweep latch is so substantial that the static load will actually slide off the latch arm. Because of this problem, such window latches have not been able to pass the static load test.

Thus, there remains a need for a new and improved locking window having a window latch which may be completely formed from chip resistant plastics while, at the same time, still provides sufficient strength due to its offset arrangement to resist normal wear and tear during assembly and use.

SUMMARY OF THE INVENTION

The present invention is directed to a locking window. The window includes a window frame including at least one window sash which is selectively movable between a first closed position and a second open position. A window latch is adapted to be attached to the window and is selectively movable between a first open position and a second locked position to secure the window sash in the closed position. The window latch includes a sweep latch, preferably offset, and a non-compressible pivot fastener for attaching the window latch to the window.

The offset sweep latch includes an actuator arm, a locking arm and a pivot point location between the actuator arm and the locking arm. In the preferred embodiment, a reinforcing shoulder extends between the pivot point location and along at least a portion of the actuator arm and a strengthening web extends between the actuator arm and the locking arm adjacent to the pivot point location. The offset arrangement provides sufficient space for substantially unequal length actuator and locking arm. In the preferred embodiment, the ratio of the length of the actuator arm to the length of the locking arm is greater than about 2 to provide a mechanical advantage when the window latch is operated. Also, the distal end of the locking arm may be inclined to provide an additional mechanical advantage when the window latch is operated.

The pivot fastener includes a support bushing and a fastener extending through the support bushing for attaching the sweep latch to the window. In the preferred embodiment, the base of the support bushing extends outward to form a load distributing surface and the distal end of the support bushing extends above the surface of the sweep latch to allow the sweep to move freely about the pivot fastener.

A housing substantially covers and protects the pivot fastener. In the preferred embodiment, the housing extends beyond the pivot fastener parallel to the window frame and includes an aperture for receiving a fastener for attaching the housing to the window. A portion of the housing extending beyond the pivot fastener parallel to the window frame may include a finger well for providing access to the offset sweep latch.

In the preferred embodiment, a detent is located between the housing and the sweep latch for retaining the sweep latch in one of the open and the locked positions. The detent also provides an audible indication of the sweep latch in one of the open and the locked positions.

Accordingly, one aspect of the present invention is to provide a locking window. The window includes: a window frame including at least one window sash which is selectively movable between a first closed position and a second open position; and a window latch adapted to be attached to the window and which is selectively movable between a first open position and a second locked position to secure the window sash in the closed position, the window latch including a sweep latch and a non-compressible pivot fastener for attaching the window latch to the window.

Another aspect of the present invention is to provide a window latch for a locking window, the window having a window frame including at least one window sash which is selectively movable between a first closed position and a second open position. The window latch includes: an offset sweep latch; and a non-compressible pivot fastener for attaching the window latch to the window, the pivot fastener including a support bushing and a fastener extending through the support bushing for attaching the offset sweep latch to the window, whereby the window latch is selectively movable between a first open position and a second locked position to secure the window sash in the closed position.

Still another aspect of the present invention is to provide a locking window. The window includes: a window frame including at least one window sash which is selectively movable between a first closed position and a second open position; a window latch adapted to be attached to the window and which is selectively movable between a first open position and a second locked position to secure the window sash in the closed position, the window latch including an offset sweep latch and a non-compressible pivot fastener for attaching the window latch to the window, the pivot fastener including a support bushing and a fastener extending through the support bushing for attaching the offset sweep latch to the window; and a housing for substantially covering the pivot fastener.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1:
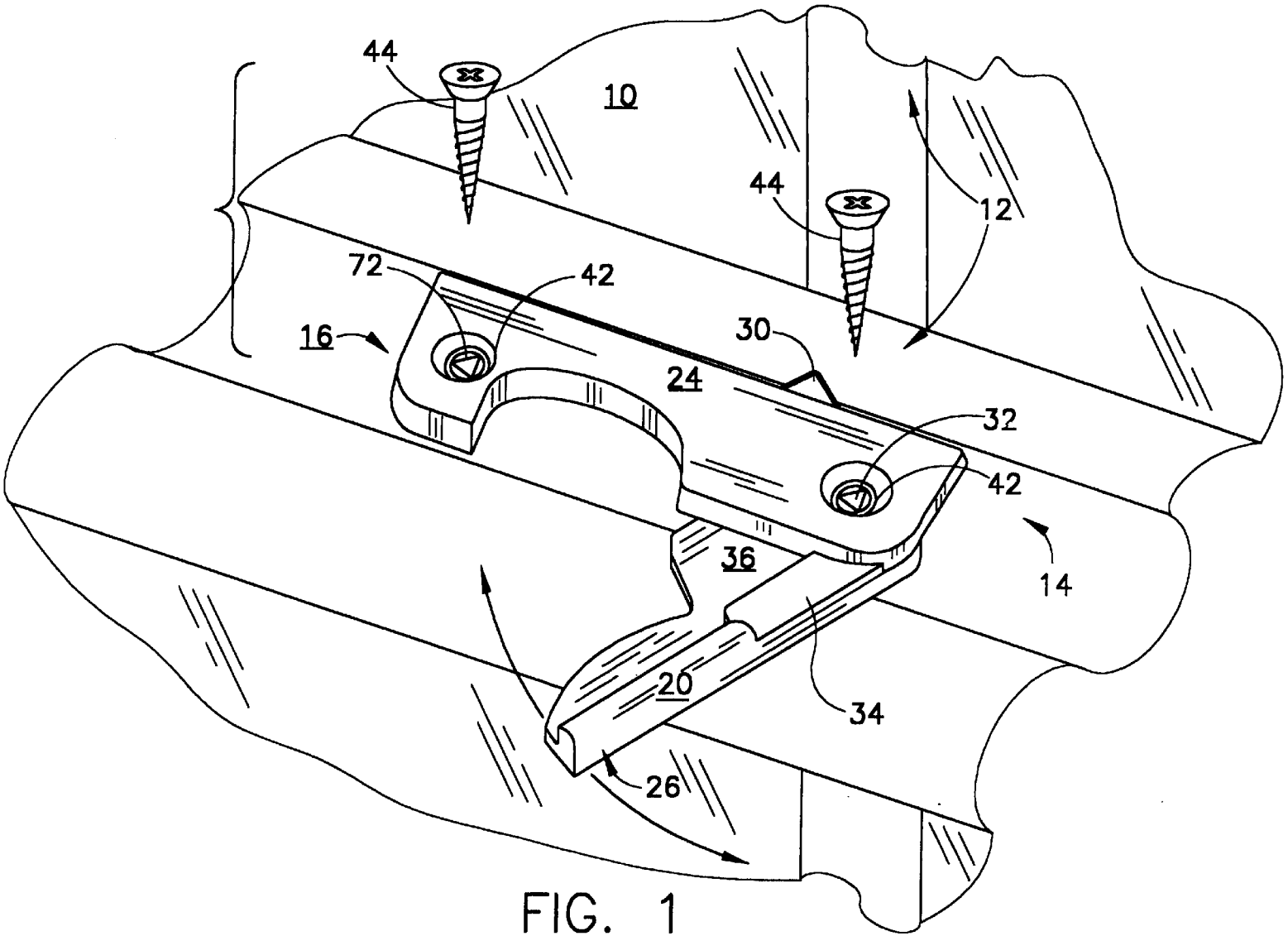
FIG. 1 is a perspective view of a locking window constructed according to the present intention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. A perspective view of the window locking system 10 is shown in FIG. 1. The window latch subassembly 16 is fastened to the frame 12 of the window and includes a housing 24 and an offset sweep latch 20. The offset sweep latch 20 includes an actuator arm 26 and locking arm 30.

The window 12 is locked by pivotally moving the actuator arm 26 inward toward the housing 24, causing the locking arm 30 to pivotally move away from the housing and engage a groove 14 located in the frame of the window 12. The locking arm 30 disengages the groove 14 and unlocks the window when the actuator arm 26 pivotally moves away from the housing 24.

Figure 7:
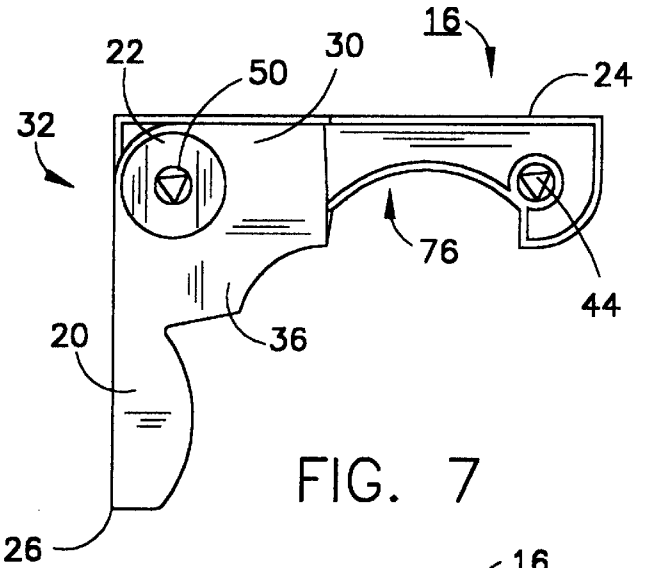
FIG. 7 is bottom view of the window latch shown in its open position.
Figure 5:
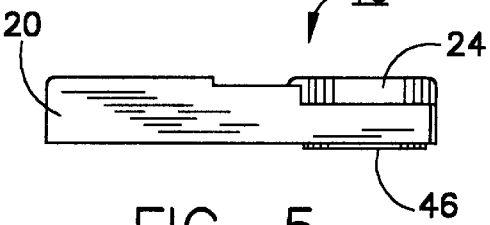
FIG. 5 is the opposite view of the window latch shown in its open position.
Figure 6:
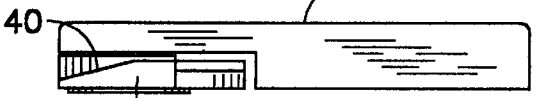
FIG. 6 is a back view of the window latch shown in its open position.
Figure 2:
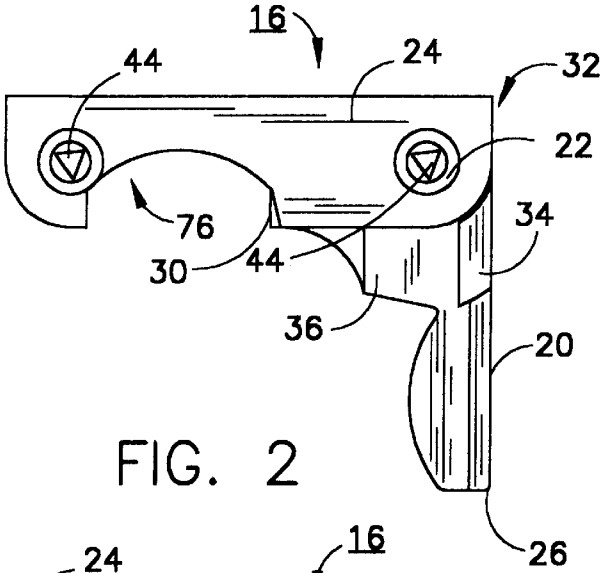
FIG. 2 is a top view of the window latch subassembly of the locking window shown in its open position.
Figure 4:
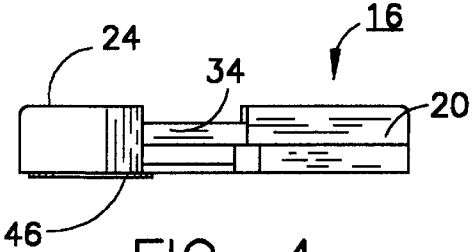
FIG. 4 is a side view of the window latch shown in its open position.
Figure 3:
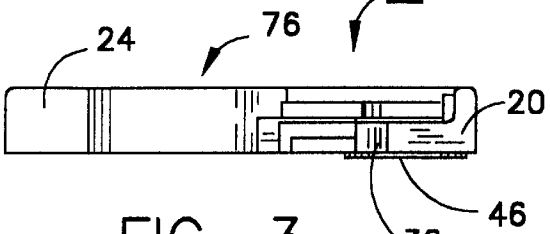
FIG. 3 is a front view of the window latch shown in its open position.
Figure 10:
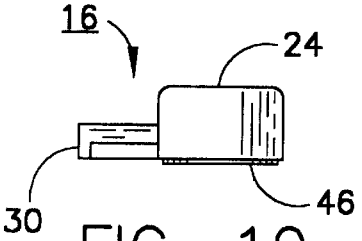
FIG. 10 is the window latch shown in FIG. 4 in its closed position.
Figure 13:
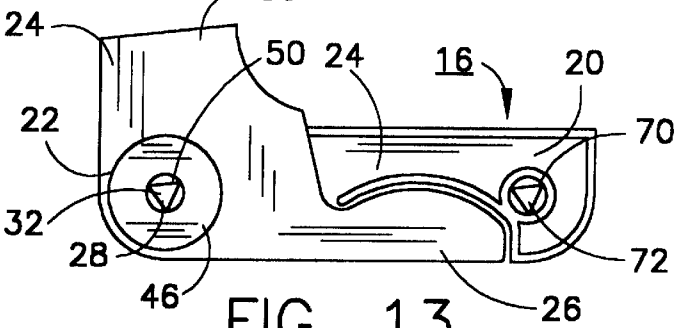
FIG. 13 is the window latch shown in FIG. 7 in its close position.
Figure 8:
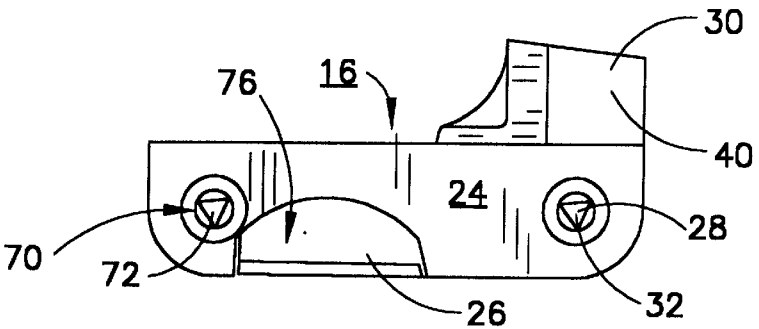
FIG. 8 is the window latch shown in FIG. 2 in its closed position.
Figure 11:
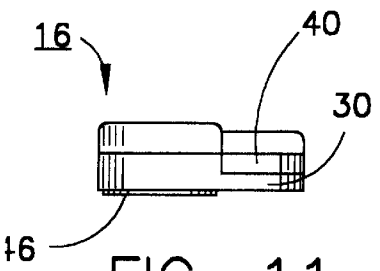
FIG. 11 is the window latch shown in FIG. 5 in its closed position.

As best seen in FIGS. 8 and 13, in the locked position, the locking arm 30 protrudes beyond the face of the window latch subassembly 16 and extends into the groove 14 within the frame of the window 12, while the actuator arm 26 is withdrawn into the housing 24 of the window latch subassembly 16 so as to be flush with the outer surface of the housing 24. As best seen in FIGS. 2 and 7, in the open position, the locking arm 30 is withdrawn from the groove 14 and concealed within the housing 24 of the window latch subassembly 16, while at the same time, the actuator arm 26 of the offset sweep latch 20 is fully extended perpendicularly outward beyond the outer face of the housing 24 of the window latch subassembly 16.

As previously mentioned, the offset sweep latch 20 includes an actuator arm 26 and a locking arm 30. The offset sweep latch 20 pivots about a pivot point 32, and has two arms: the actuator arm 26 and the locking arm 30. The offset sweep latch 20 has an aperture at the pivot point 32 to accommodate a non-compressible pivot fastener 22. The length of the actuator arm 26 is approximately twice the length of the locking arm 30, thereby providing a mechanical advantage in opening and locking the window 12.

Figure 12:
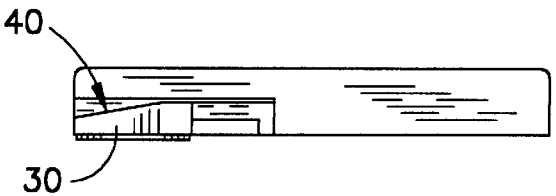
FIG. 12 is the window latch shown in FIG. 6 in its closed position.
Figure 9:
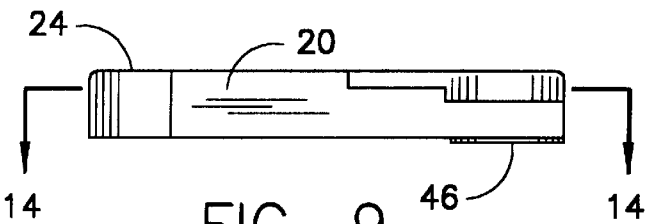
FIG. 9 is the window latch shown in FIG. 3 in its closed position.
Figure 14:
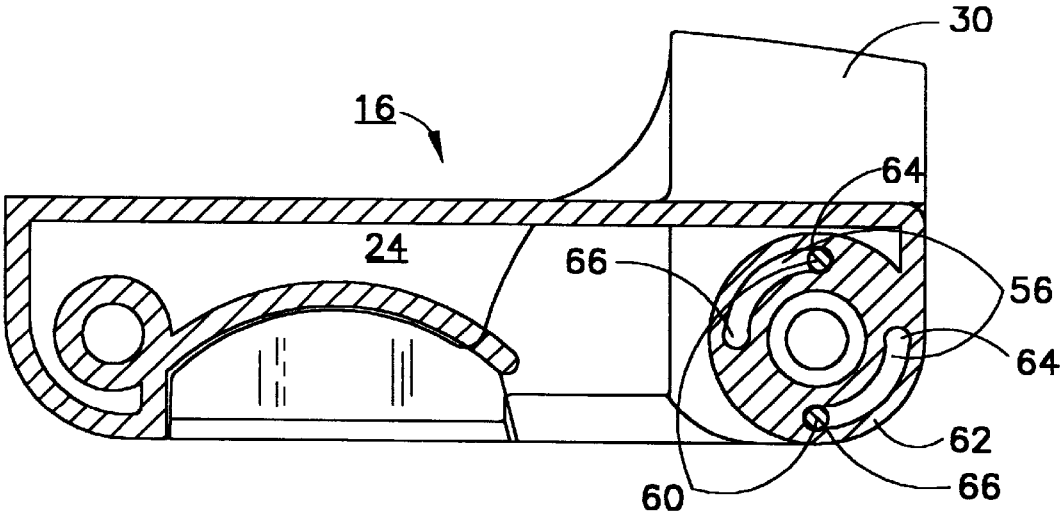
FIG. 14 is a partial fragmentary view of the window latch shown in FIG. 8, illustrating the detent.

As seen in FIGS. 2 and 7, in the preferred embodiment, the offset sweep latch 20 is strengthened by a strengthening web 36 located between the actuator arm 26 and the pivot point location 32. The locking arm 30 may also include an inclined face 40, seen in FIG. 12, to better facilitate insertion of the locking arm 30 into the groove 14 of the window 12.

Figure 15:
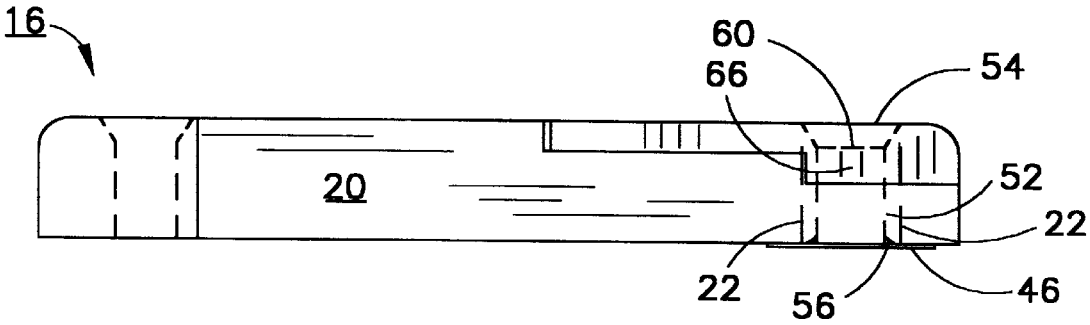
FIG. 15 is a partial fragmentary view of the window latch shown in FIG. 9, illustrating the detent.

The non-compressible pivot fastener 22 is shown in profile in FIG. 15 and in bottom views of the window latch subassembly 16, shown in FIGS. 7 and 13. The non-compressible pivot fastener 22 allows the offset sweep latch 20 to pivot freely about the pivot point 32 while the window latch subassembly 16 is affixed to the window frame 12, and includes a support bushing 42 having a central aperture which allows a fastener 44 to pass therethrough. The support bushing 42 has a lower load-bearing surface 46, as seen in the bottom view of FIGS. 7 and 13. The support bushing 42 also includes a distal end 52 that extends above the sweep latch 20. The distal end 52 prevents compression of the sweep latch 20 when the window latch subassembly 16 is affixed to the window frame 12.

In the preferred embodiment, the support bushing 42 further includes a cavity 50 in its bottom surface to accommodate shavings generated when the window latch subassembly 16 is affixed to the window frame 12, or to accommodate any pull-up of the window frame 12 during attachment of the window latch subassembly 16 to the window frame 12.

In addition, the support bushing 42 may include a snap fit lock with a latch 54 on its distal end 52. The snap fit lock with latch 54 enables the distal end and thereby the entire non-pressible pivot fastener 22 to be securely attached to the window latch subassembly 16; that is, to be securely attached to the offset sweep latch 20. The snap fit lock with latch 54 may be a rib around the outer surface of the distal end 52 extending above the sweep latch 20, and the sweep latch 20 may have a complementary rib to mate with the snap fit lock and latch 54. The fastener 44 in the preferred embodiment may be any threaded fastener, such as a screw.

A housing 24 having at least a single aperture 28 partially encloses both the sweep latch 20 and non-compressible pivot fastener 22, protecting them from debris that may be generated during construction or installation of the window frame 12.

The aperture 28 serves as a first attachment point and, in the preferred embodiment, the housing 24 includes a second aperture 72 which serves as a second attachment point 70 for the window latch subassembly 16.

Apertures 28 and 72 may each further include an internal retainer 74, which may be a small piece of plastic molded into the aperture 72 or aperture 28 that allows a fastener 44 to be temporarily secured in apertures 28 and 72 for packaging or shipping purposes and to prevent loss.

The housing 24 also has an underside or bottom surface may also include a detent 56 that limits the range of movement of the sweep latch 20. The detent 56 includes at least one groove 62. In the preferred embodiment, the detent includes a pair of grooves 62 having a slightly enlarged diameter 64 and 66 at either end of each respective groove. Each groove 62 in the detent 56 cooperates with a corresponding protrusion 60 located on the upper surface of the sweep latch 20. In the preferred embodiment, the protrusions 60 are located proximate to the pivot point 32 of the sweep latch 20. Also in the preferred embodiment, two protrusions 60 on the upper surface of the sweep latch 20 mate with two grooves 62 of the detent 56 located on the bottom surface of the housing 24.

As the sweep latch 20 moves along its range of motion, the protrusions 60 travel along and in the corresponding grooves 62 until one of the barbell shaped regions 64 and 66 of the groove is reached. At this point, the protrusion 60 enters a barbell shaped region 64 of groove 62, producing an audible snap. The audible snap assists the user in determining whether the window latch subassembly 16 is in a fully engaged or fully disengaged position.

The window latch subassembly 16 may be formed from any lightweight durable material, such as a lightweight metal including aluminum, or a polymeric material. In the preferred embodiment, the material used to form the window latch subassembly 16 is a glass reinforced nylon material such as Chem 1223, manufactured by Chem Polymers of Fort Myers, Fla.

The strength of the present invention is shown by the following test results:

TEST 1: Uniform Static Structural Load Test ASTM E330-96—ten-second load duration. Measurements taken at center mid-span of the fixed meeting rail. Design Pressure Rating 25. Test Load 37.5 PSF. Maximum Allowable Permanent Set 0.160".

Results: Positive Deflection at load: 0.487". Positive Permanent Set after load released: 0.011". Negative Deflection at load: 0.714". Negative Permanent Set after load released: 0.046".

TEST 2: Forced Entry Resistance Test—ASTM F588

Results: The present invention passed at the performance level 10.

As can be seen from the above test results, a locking window and window latch constructed according to the present invention, may be completely formed from chip resistant plastics while, at the same time, still provides sufficient strength due to its offset arrangement to resist normal wear and tear during assembly and use.

Certain modifications and improvements will occur to those skilled in the art upon a reading of the foregoing description. For example, in some high stress applications, housing 24 may be further extended for a third screw off to one side. It should be understood that all such modifications and improvements have been deleted herein for the sake of conciseness and readability but are properly within the scope of the following claims.

We claim:

1. A locking window, said window comprising:

(a) a window frame including at least one window sash which is selectively movable between a first closed position and a second open position; and (b) a window latch adapted to be attached to said window and which is selectively movable between a first open position and a second locked position to secure said window sash in said closed position, said window latch including a sweep latch and a non-compressible pivot fastener for attaching said window latch to said window, said pivot fastener including a support bushing.

2. The apparatus according to claim 1, further including a housing for substantially covering said pivot fastener.

3. The apparatus according to claim 2, further including a detent between said housing and said sweep latch for retaining said sweep latch in one of said open and said locked positions.

4. The apparatus according to claim 3, wherein said detent provides an audible indication of said sweep latch in one of said open and said locked positions.

5. The apparatus according to claim 3, wherein said detent includes at least one protrusion on one of said housing and said sweep latch and a semi-circular receiving groove on the other of said housing and said sweep latch, said semi-circular groove including at least one barbell shaped portion for receiving said protrusion, said protrusion being substantially parallel to the axis of said pivot fastener and said groove being substantially perpendicular to the axis of said pivot fastener.

6. The apparatus according to claim 2, wherein said housing extends beyond said pivot fastener parallel to said window frame and includes an aperture for receiving a fastener for attaching said housing to said window.

7. The apparatus according to claim 6, wherein said aperture for receiving a fastener for attaching said housing to said window includes a retainer for receiving said fastener.

8. The apparatus according to claim 2, wherein the portion of said housing extending beyond said pivot fastener parallel to said window frame includes a finger well for providing access to said sweep latch.

9. A window latch for a locking window, said window having a window frame including at least one window sash which is selectively movable between a first closed position and a second open position, said window latch comprising:

(a) an offset sweep latch; and (b) a non-compressible pivot fastener for attaching said window latch to said window, said pivot fastener including a support bushing and a fastener extending through said support bushing for attaching said offset sweep latch to said window, whereby said window latch is selectively movable between a first open position and a second locked position to secure said window sash in said closed position.

10. The apparatus according to claim 9, wherein the base of said support bushing extends outward to form a load distributing surface and the distal end of said support bushing extends above the surface of said offset sweep latch to allow said offset sweep to move freely about said pivot fastener.

11. The apparatus according to claim 9, wherein the base of said support bushing includes a cavity for receiving shavings formed by attaching said window latch to said window.

12. The apparatus according to claim 9, wherein the distal end of said support bushing includes a snap fit lock for connecting said support bushing to said window latch.

13. The apparatus according to claim 9, wherein said fastener is a self-tapping threaded fastener.

14. The apparatus according to claim 9, wherein said offset sweep latch includes an actuator arm, a locking arm and a pivot point location between said actuator arm and said locking arm.

15. The apparatus according to claim 14, further including a reinforcing shoulder extending between said pivot point location and along at least a portion of said actuator arm.

16. The apparatus according to claim 14, further including a strengthening web extending between said actuator arm and said locking arm adjacent to said pivot point location.

17. The apparatus according to claim 14, wherein the ratio of the length of said actuator arm to the length of said locking arm is greater than about 2 to provide a mechanical advantage when said window latch is operated.

18. The apparatus according to claim 14, wherein the distal end of said locking arm is inclined to provide a mechanical advantage when said window latch is operated.

19. A locking window, said window comprising:

(a) a window frame including at least one window sash which is selectively movable between a first closed position and a second open position;

(b) a window latch adapted to be attached to said window and which is selectively movable between a first open position and a second locked position to secure said window sash in said closed position, said window latch including an offset sweep latch and a non-compressible pivot fastener for attaching said window latch to said window, said pivot fastener including a support bushing and a fastener extending through said support bushing for attaching said offset sweep latch to said window; and (c) a housing for substantially covering said pivot fastener.

20. The apparatus according to claim 19, further including a detent between said housing and said offset sweep latch for retaining said offset sweep latch in one of said open and said locked positions.

21. The apparatus according to claim 20, wherein said detent provides an audible indication of said offset sweep latch in one of said open and said locked positions.

22. The apparatus according to claim 20, wherein said detent includes at least one protrusion on one of said housing and said offset sweep latch and a semicircular receiving groove on the other of said housing and said offset sweep latch, said semi-circular groove including at least one barbell shaped portion for receiving said protrusion, said protrusion being substantially parallel to the axis of said pivot fastener and said groove being substantially perpendicular to the axis of said pivot fastener.

23. The apparatus according to claim 19, wherein said housing extends beyond said pivot fastener parallel to said window frame and includes an aperture for receiving a fastener for attaching said housing to said window.

24. The apparatus according to claim 23, wherein said aperture for receiving a fastener for attaching said housing to said window includes a retainer for receiving said fastener.

25. The apparatus according to claim 19, wherein the portion of said housing extending beyond said pivot fastener parallel to said window frame includes a finger well for providing access to said offset sweep latch.

26. The apparatus according to claim 19, wherein the base of said support bushing extends outward to form a load distributing surface and the distal end of said support bushing extends above the surface of said offset sweep latch to allow said offset sweep to move freely about said pivot fastener.

27. The apparatus according to claim 19, wherein the base of said support bushing includes a cavity for receiving shavings formed by attaching said window latch to said window.

28. The apparatus according to claim 19, wherein the distal end of said support bushing includes a snap fit lock for connecting said support bushing to said window latch.

29. The apparatus according to claim 19, wherein said fastener is a self-tapping threaded fastener.

30. The apparatus according to claim 19, wherein said offset sweep latch includes an actuator arm, a locking arm and a pivot point location between said actuator arm and said locking arm.

31. The apparatus according to claim 30, further including a reinforcing shoulder extending between said pivot point location and along at least a portion of said actuator arm.

32. The apparatus according to claim 30, further including a strengthening web extending between said actuator arm and said locking arm adjacent to said pivot point location.

33. The apparatus according to claim 30, wherein the ratio of the length of said actuator arm to the length of said locking arm is greater than about 2 to provide a mechanical advantage when said window latch is operated.

34. The apparatus according to claim 30, wherein the distal end of said locking arm is inclined to provide a mechanical advantage when said window latch is operated.

* * * * *